US009611650B1

(12) United States Patent
Bizzarri et al.

(10) Patent No.: US 9,611,650 B1
(45) Date of Patent: Apr. 4, 2017

(54) RAIL SYSTEM AND METHOD FOR ASSEMBLY

(75) Inventors: Paul M. Bizzarri, Mason, OH (US); Chip Herr, Columbus, OH (US); John M. Previte, Dublin, OH (US); Kevin T. Burt, Columbus, OH (US); William G. Taylor, Columbus, OH (US); Matthew T. Fenneman, Gahanna, OH (US); Jeffrey R. Burr, Loveland, OH (US); Timothy C. Rothwell, Dublin, OH (US)

(73) Assignee: CPG International LLC, Scranton, PA (US)

( * ) Notice: Subject to any disclaimer, the term of this patent is extended or adjusted under 35 U.S.C. 154(b) by 748 days.

(21) Appl. No.: 13/461,496

(22) Filed: May 1, 2012

Related U.S. Application Data

(63) Continuation of application No. 12/831,064, filed on Jul. 6, 2010, now Pat. No. 8,167,275, which is a continuation of application No. 11/292,269, filed on Nov. 30, 2005, now abandoned.

(51) Int. Cl.
*E04F 11/00* (2006.01)
*E04F 11/18* (2006.01)

(52) U.S. Cl.
CPC ..... *E04F 11/1834* (2013.01)

(58) Field of Classification Search
CPC ..... E04F 11/1834; E04H 2017/1491
USPC ..... 256/21, 22, 59, 65.01, 65.02, 65.07, 256/65.08, 65.14
See application file for complete search history.

(56) References Cited

U.S. PATENT DOCUMENTS

| | | | | |
|---|---|---|---|---|
| 2,932,488 | A | 4/1960 | Dotson | |
| D189,447 | S | 12/1960 | Altwood | |
| D199,024 | S | 9/1964 | Huret | |
| D200,702 | S | 3/1965 | Huret | |
| D210,519 | S | 3/1968 | Kusel | |
| 3,420,505 | A | 1/1969 | Jefferys | |
| 3,463,456 | A * | 8/1969 | Walker | 256/22 |
| 3,498,589 | A * | 3/1970 | Murdock | 256/70 |
| 3,707,276 | A | 12/1972 | Francis et al. | |

(Continued)

FOREIGN PATENT DOCUMENTS

| | | |
|---|---|---|
| CA | 1213767 A | 11/1986 |
| CA | D80640 | 5/1997 |

(Continued)

OTHER PUBLICATIONS

Advanced Environmental Recycling Technologies, Inc., Composite Railing Installation, www.moistureshield.com, Jul. 2015.

(Continued)

*Primary Examiner* — Victor Macarthur
(74) *Attorney, Agent, or Firm* — Standley Law Group LLP

(57) ABSTRACT

A rail system that may be comprised of various components such as an upper rail, support rail, bottom rail, squash blocks, balusters, post covers, and ancillary components, such as post skirts and caps. In one exemplary embodiment, the rail system may be uniquely designed to accommodate perpendicular and angled installations (e.g., both in the horizontal and vertical planes). Furthermore, in another exemplary embodiment, the rail system may be easily assembled such that the support hardware is substantially hidden from view after installation, thereby enhancing the appearance of the railing.

20 Claims, 14 Drawing Sheets

(56) References Cited

U.S. PATENT DOCUMENTS

| | | | | |
|---|---|---|---|---|
| 3,756,567 | A * | 9/1973 | Murdock | 256/21 |
| 3,879,017 | A | 4/1975 | Maxcy et al. | |
| 3,955,800 | A * | 5/1976 | Russo | 256/59 |
| D251,451 | S | 3/1979 | Toder | |
| D293,718 | S | 1/1988 | Poma | |
| 4,995,591 | A | 2/1991 | Humphrey et al. | |
| D335,353 | S | 5/1993 | Baker | |
| D358,982 | S | 6/1995 | Bosgoed | |
| 5,443,244 | A | 8/1995 | Gibbs | |
| D375,573 | S | 11/1996 | Andres | |
| 5,649,688 | A | 7/1997 | Baker | |
| 6,009,682 | A | 1/2000 | Lehman et al. | |
| D419,858 | S | 2/2000 | Bosgoed | |
| 6,029,954 | A * | 2/2000 | Murdaca | 256/59 |
| 6,061,991 | A * | 5/2000 | Dahl | 52/832 |
| D461,914 | S | 8/2002 | Hughes et al. | |
| D471,284 | S | 3/2003 | Heath | |
| 6,702,259 | B2 | 3/2004 | Pratt | |
| 6,715,242 | B1 | 4/2004 | Green et al. | |
| 6,874,766 | B2 * | 4/2005 | Curatolo | 256/59 |
| D509,599 | S | 9/2005 | MacDonald | |
| D536,098 | S | 1/2007 | Walker | |
| 7,543,802 | B2 * | 6/2009 | Petta et al. | 256/65.08 |
| D625,989 | S | 10/2010 | Mancosh et al. | |
| 7,875,655 | B2 | 1/2011 | Mancosh et al. | |
| 7,923,477 | B2 | 4/2011 | Murdock et al. | |
| 8,167,275 | B1 * | 5/2012 | Bizzarri et al. | 256/65.08 |
| 8,278,365 | B2 | 10/2012 | Murdock et al. | |
| 8,455,558 | B2 | 6/2013 | Mancosh et al. | |
| 8,809,406 | B2 | 8/2014 | Murdock et al. | |
| 9,073,295 | B2 | 7/2015 | Przybylinski et al. | |
| 2003/0196395 | A1 | 10/2003 | Forbis et al. | |
| 2005/0051761 | A1 | 3/2005 | Caissie et al. | |
| 2005/0127346 | A1 * | 6/2005 | Steffes | A47H 1/144 256/65.05 |
| 2006/0076545 | A1 * | 4/2006 | Reynders et al. | 256/59 |
| 2006/0113441 | A2 * | 6/2006 | Cicenas et al. | 248/219.1 |
| 2006/0147693 | A1 | 7/2006 | Przybylinski et al. | |
| 2007/0173551 | A1 | 7/2007 | Mancosh et al. | |
| 2008/0064794 | A1 | 3/2008 | Murdock et al. | |
| 2008/0093763 | A1 | 4/2008 | Mancosh et al. | |
| 2008/0128933 | A1 | 6/2008 | Przybylinski et al. | |
| 2008/0213562 | A1 | 9/2008 | Przybylinski et al. | |
| 2010/0159213 | A1 | 6/2010 | Przybylinski et al. | |
| 2011/0073824 | A1 | 3/2011 | Lappin et al. | |
| 2011/0097552 | A1 | 4/2011 | Mancosh et al. | |
| 2011/0229691 | A1 | 9/2011 | Murdock et al. | |
| 2012/0077890 | A1 | 3/2012 | Mancosh et al. | |
| 2012/0315471 | A1 | 12/2012 | Mancosh et al. | |
| 2013/0102707 | A1 | 4/2013 | Murdock et al. | |
| 2015/0024171 | A1 | 1/2015 | Murdock et al. | |
| 2015/0044434 | A1 | 2/2015 | Kotiadis et al. | |

FOREIGN PATENT DOCUMENTS

| | | | |
|---|---|---|---|
| ES | 1041676 | | 11/1998 |
| FR | 2529925 | A1 | 1/1984 |
| GB | 567071 | | 1/1945 |
| KR | 20040044680 | A | 5/2004 |
| WO | D064769-006 | | 10/2003 |

OTHER PUBLICATIONS

Advanced Environmental Recycling Technologies, Inc., Magnum Railing www.lifecycedecking.com/products/profiles , Oct. 17, 2010, visited Jan. 29, 2016 via https://web.archive.org/web/20101017132410/http://lifecycledecking.com/products/profiles.

CertainTeed Corporation, www.certainteed.com/products/fence-railing-deck/railing/313628 Mar. 7, 2009, visited Jan. 29, 2016 via https://web.archive.org/web/20090307163124/http://www.certainteed.com/products/fence-railing-deck/railing/313628.

CertainTeed Corporation, Step-By-Step Installation Instructions for Panorama Composite Railing System Square or Steel Balusters, Aug. 2014.

CertainTeed Corporation, Panorama, Registration No. 3,326,317, registered Oct. 30, 2007.

CertainTeed Corporation, Panorama Composite Railing System, www.certainteed.com/products/fence-railing-deck/railing/313628, visited Jan. 29, 2016.

Alleged pictures of Trex Transcend Top Rail, Green Bay Decking—Integra Rail, RDI Transform Series Rail, Gossen Railing, and Menards Ultradeck Railing, received on or about Dec. 4, 2015, from third party (titles and miscellaneous text have been added by third party; original sources/authors, titles, and publication dates of pictures not known).

Alleged pictures of Fiberon/Fiber Composites, LLC Railing allegedly circa 2002, Gossen Railing, AERT Railing, and Certainteed Panorama Railing, received on or about Dec. 4, 2015, from third party (titles and miscellaneous text/ symbols have been added by third party; original sources/authors, titles, and publication dates of pictures not known).

Gossen Corporation, Performance Railing System, http://www.gossencorp.com/railing.php, Jun. 11, 2014, visited Jan. 29, 2016 via https://web.archive.org/web/20140611083437/http://www.gossencorp.com/railing.php.

Gossen Corporation, Code Compliance Research Report CCRR-0221, Apr. 7, 2015.

Gossen Corporation, Gossen WeatherReady Railing, http://www.gossencorp.com/railing.php, Sep. 3, 2012, visited Jan. 29, 2016 via https://web.archive.org/web/20120903150713/http://www.gossencorp.com/railing.php.

Green Bay Decking LLC, Integra Rail, U.S. Appl. No. 77/852,500, filed Oct. 20, 2009.

The Des Moines Register, p. 405, Jun. 29, 2003.

Midwest Manufacturing, Natural Railing, http://www.midwestmanufacturing.com/MidwestManufacturing/productDetail.do?groupId=1&lineId=8&productTypeId=4&productId=201 , Sep. 22, 2014, visited Jan. 26, 2016 via https://web.archive.org/web/20140922121245/http://www.midwestmanufacturing.com/MidwestManufacturing/productDetail.do?groupId=1&lineId=8&productType Id=4&productId=201.

Midwest Manufacturing, Pinnacle Top Rail Caps, http://www.midwestmanufacturing.com/MidwestManufacturing/productDetail.do?groupId=1 &lineId=8&productTypeId=4&productId=1366, Aug. 3, 2010, visited Jan. 28, 2016 via https://web.archive.org/web/20100803030153/http://www.midwestmanufacturing.com/MidwestManufacturing/productDetail.do?groupId=l&lineId=8&productTypeId=4&productId=1366.

UltraDeck Reversible, http://ultradeck.com/products.htm, Feb. 13, 2005, visited Jan. 28, 2016 via https://web.archive.org/web/20050213125854/http://ultradeck.com/products.htm.

Midwest Manufacturing, UltraDeck Rustic Rail, http://www.midwestmanufacturing.com/MidwestManufacturing/productDetaiI.do?groupId=1&IineId=8&productTypeId=4&productId=200 , May 22, 2013, visited Jan. 26, 2016 via https://web.archive.org/web/20130522185339/http://www.midwestmanufacturing.com/MidwestManufacturing/productDetaiI.do?groupId=l&IineId=8&productTypeId=4&productId=200.

Menard, Inc., Ultradeck, Registration No. 2,933,451, registered Mar. 15, 2005.

Railing Dynamics, Inc., Transform, Registration No. 4,569,628, registered Jul. 15, 2014 and Transform (& Design), Registration No. 4,569,629, registered Jul. 15, 2014.

Trex Company, Inc. Trex Artisan Series Railing, Registration No. 3,182,562, registered Dec. 12, 2006.

Google Images, Trex Transcend Railing, example at https://www.google.com/search?q=trex+transcend+railing&rlz=1C2OPRB_enUS555US555&biw=1424&bih=951&tbm=isch&tbo=u&source=univ&sa=X&sqi=2&ved=0ahUKEwjbqK-EztfKAhUHuIMKHYSyAnQQsAQIPg#imgrc=_, example visited Jan. 26, 2016.

Trex Company, Inc., Trex Transcend, Registration No. 4,107,731, registered Mar. 6, 2012.

(56) References Cited

OTHER PUBLICATIONS

Trex Company, Inc., Transcend, Registration No. 3,773,349, registered Apr. 6, 2010.
Trex Company, Inc., Transcend, www.trex.com/products/railing/transcend/, visited Jan. 26, 2016.

* cited by examiner

RAIL SYSTEM AND METHOD FOR ASSEMBLY

This application is a continuation of U.S. application Ser. No. 12/831,064, filed Jul. 6, 2010 now U.S. Pat. No. 8,167,275, which is a continuation of U.S. patent application Ser. No. 11/292,269, filed Nov. 30, 2005 now abandoned, each of which is hereby incorporated by reference in its entirety.

TECHNICAL FIELD

The present invention relates generally to railing components and systems and related methods for assembly.

BACKGROUND AND SUMMARY OF THE INVENTION

Railing systems have been used in various forms to protect and secure people, animals, and land. Railing systems have also been used to prevent entry into a designated area. While these functional railing uses continue today, railing systems may also be used for decorative purposes such as on porches and decks and around yards and gardens.

Known railing systems suffer from various drawbacks. For instance, many conventional railing systems are difficult to install, thereby requiring significant amounts of on-site labor. In addition, many railing systems require an excessive number of parts in order to complete an installation. For example, known systems may require different components for perpendicular and angled installations (e.g., relative to a support post). In other words, these systems may require different components for perpendicular installations as compared to the components used for angled installations. In fact, these systems may also require different components for angled installations in which the railing is horizontal as compared to angled installations in which the railing is at a vertical angle relative to a support post (e.g., a stair rail installation). As might be expected, the extra components may increase the complexity and cost of the manufacturing, shipping, and installation of the railing assembly. On the other hand, some existing railing assemblies may not even allow angled installations. Moreover, known railing systems may also fail to provide a desired aesthetic appearance. For example, these railing systems may leave the support hardware exposed, which limits the visual appearance of the product. In light of shortcomings such as these, there is a need for an improved rail system and method of assembly.

The present invention provides a rail system that may be comprised of any material that is suitable for the intended purpose of the railing. For example, the rail system may be comprised of a composite material that is durable and resistant to weathering. In addition, an exemplary embodiment of the rail system may be easily assembled on-site. If desired, the rail system may be at least partially pre-assembled at an off-site location. In one exemplary embodiment, the rail system may be uniquely designed to accommodate perpendicular and angled installations (e.g., both in the horizontal and vertical planes). In another exemplary embodiment, the rail system may be easily assembled such that the support hardware is substantially hidden from view after installation, thereby enhancing the appearance of the railing. In light of such benefits, the present invention may provide an easy to install, weather-resistant, safe, secure, and aesthetically pleasing rail system that is suitable for a variety of indoor and outdoor uses.

In addition to the novel features and advantages mentioned above, other features and advantages of the present invention will be readily apparent from the following descriptions of the drawings and exemplary embodiments.

DETAILED DESCRIPTION OF EXEMPLARY EMBODIMENT(S)

Figure 1:
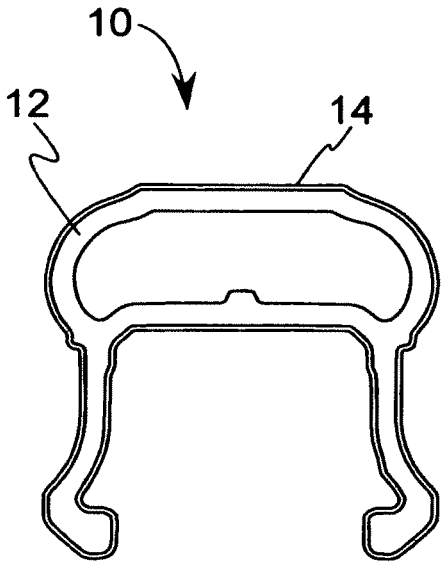
FIG. 1 is a cross-sectional view of an exemplary embodiment of a rail of the present invention.

FIG. 1 illustrates an example of a component of the present invention. In this example, handrail 10 is comprised of a composite substrate 12 and a capstock layer 14. The handrail 10 may, for example, be useful for a deck railing system or other similar or suitable types of railing.

Figure 2:
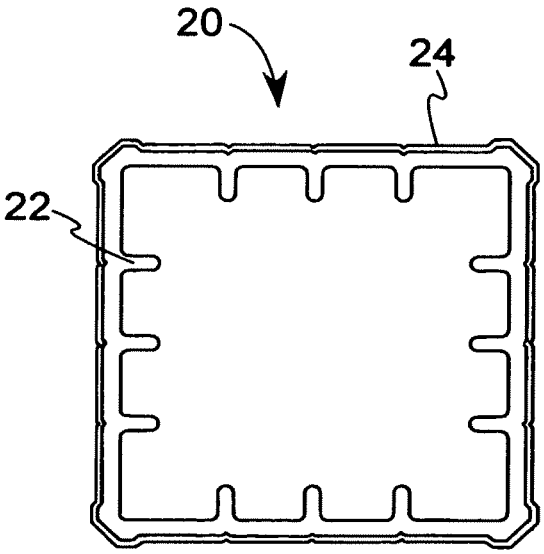
FIG. 2 is a cross-sectional view of an exemplary embodiment of a post cover of the present invention.

Another exemplary component of the present invention is illustrated in FIG. 2. FIG. 2 shows an exemplary rail post cover 20 that also comprises a composite substrate 22 and a capstock layer 24. Such a cover may be installed, for example, over an existing wood post to provide an aesthetically pleasing appearance as well as to provide protection from exposure to the elements.

FIG. 3A through 22D show an example of a railing system that may utilize the components shown in FIGS. 1 and 2. The novel features of this exemplary embodiment provide an easy method of assembling the rail components to accommodate linear and angled walkways as well as stair rail applications that require changes in elevation.

In particular, rail 10 and rail 50 may be connected to post cover 20 at a variety of horizontal and vertical angles, such as for deck and stair applications. Optional post covers 20, post caps 26, and post skirts 28 may be installed over pre-installed posts from which they derive structural rigidity and strength. Nevertheless, it should be recognized that the railing may utilize a post without the benefit of the post cover components.

Figure 3A:
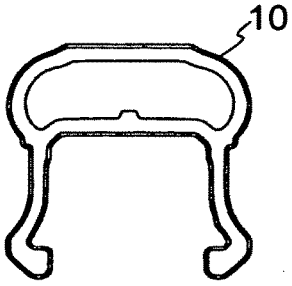
FIGS. 3A through 3K illustrate the components of an exemplary embodiment of a rail system that may utilize the present invention.
Figure 3B:
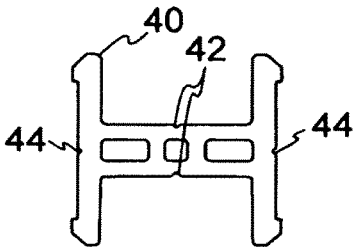
Figure 3C:
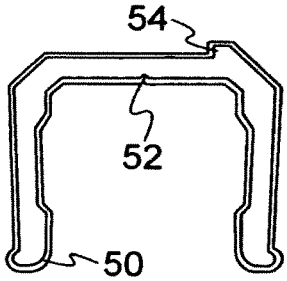
Figure 3D:
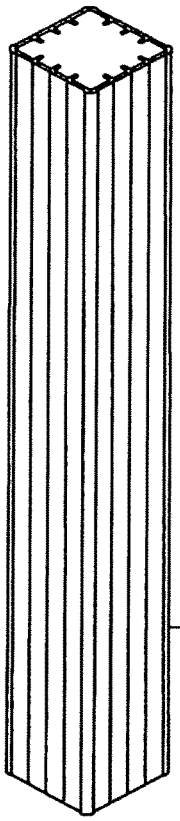
Figure 3E:
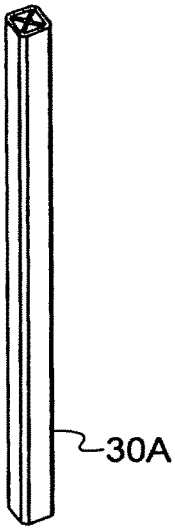
Figure 3G:
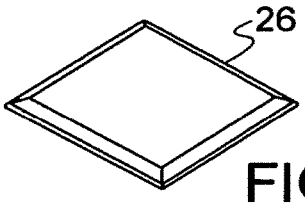
Figure 3H:
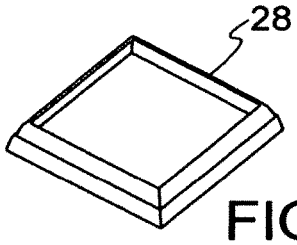
Figure 3F:
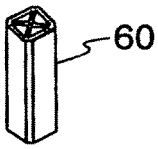
Figure 3I:
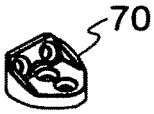
Figure 3J:
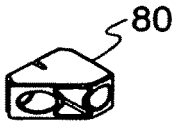

In the railing system, balusters 30A or 30B extend between an upper support rail 40 and bottom rail 50. FIG. 3E shows an example of a baluster 30A, which has inner webbing and a screw boss. However, as shown in subsequent figures, the present invention also includes baluster configurations that do not have inner webbing.

Top rail 10 and bottom rail 50 are fitted over respective support rails 40. At least one squash block 60 may be installed beneath the lower support rail 40 where desired to provide additional rigidity and support against sagging (e.g., for long spans of railing that extend between post covers 20). A squash block 60 may have a design similar to a baluster, and it may have similar means of connection to a support rail 40 as a baluster.

Figure 3K:
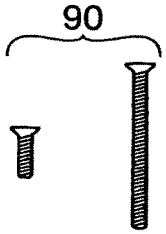

Brackets 70 and support blocks 80 provide a means for attaching the support rails 40 to the post covers 20. Optionally, fasteners 90 may be used to secure brackets 70 and support blocks 80 to post covers 20 and support rails 40. It should be noted that FIG. 3K shows various sizes of fasteners, which are collectively identified as fasteners 90. An appropriate size of fastener 90 may be selected for each intended use. Examples of fasteners 90 include, but are not limited to, screws, nails, and other similar or suitable mechanical fastening devices. In some embodiments of the railing, other means (e.g., adhesives or a suitable interference fit) may be used alone or in combination with fasteners 90 to secure brackets 70 and support blocks 80.

Figure 4:
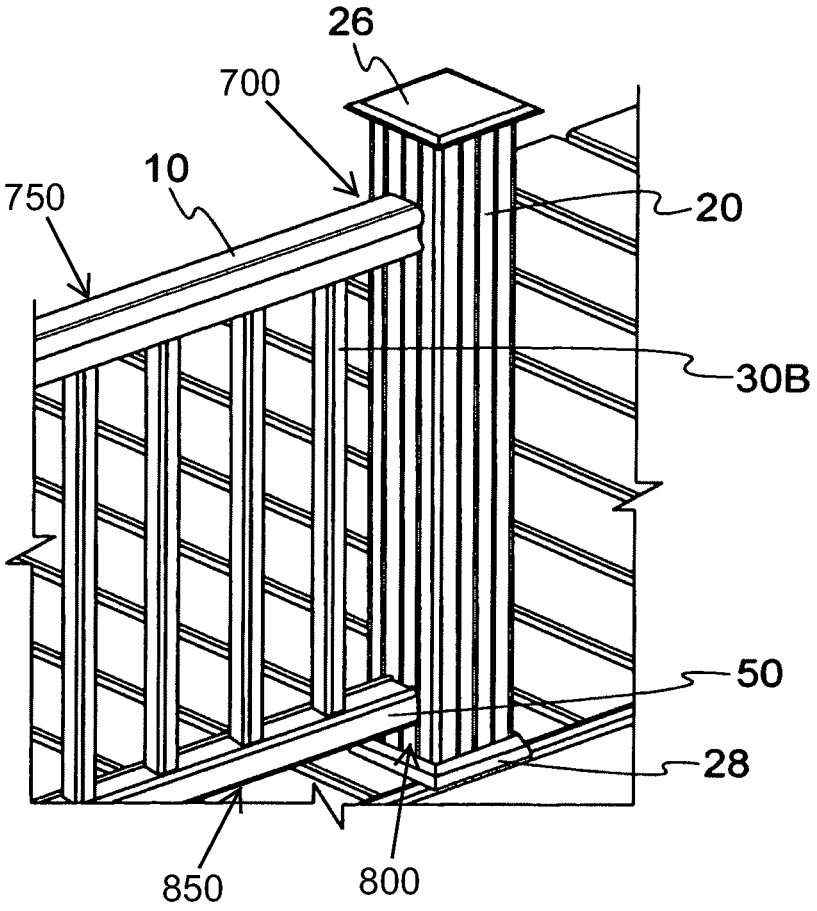
FIG. 4 is a partial perspective view of an exemplary embodiment of a rail system using at least some of the components of FIGS. 3A through 3K.

FIG. 4 illustrates an exemplary handrail installation showing the relative positions of top rail 10, post cover 20, post cap 26, post skirt 28, bottom rail 50, and interconnecting balusters 30B. It should be noted that in this exemplary embodiment, any or all of the components may be fabricated as described above to provide a durable, weather-resistant, and aesthetically pleasing railing system.

Figure 5:
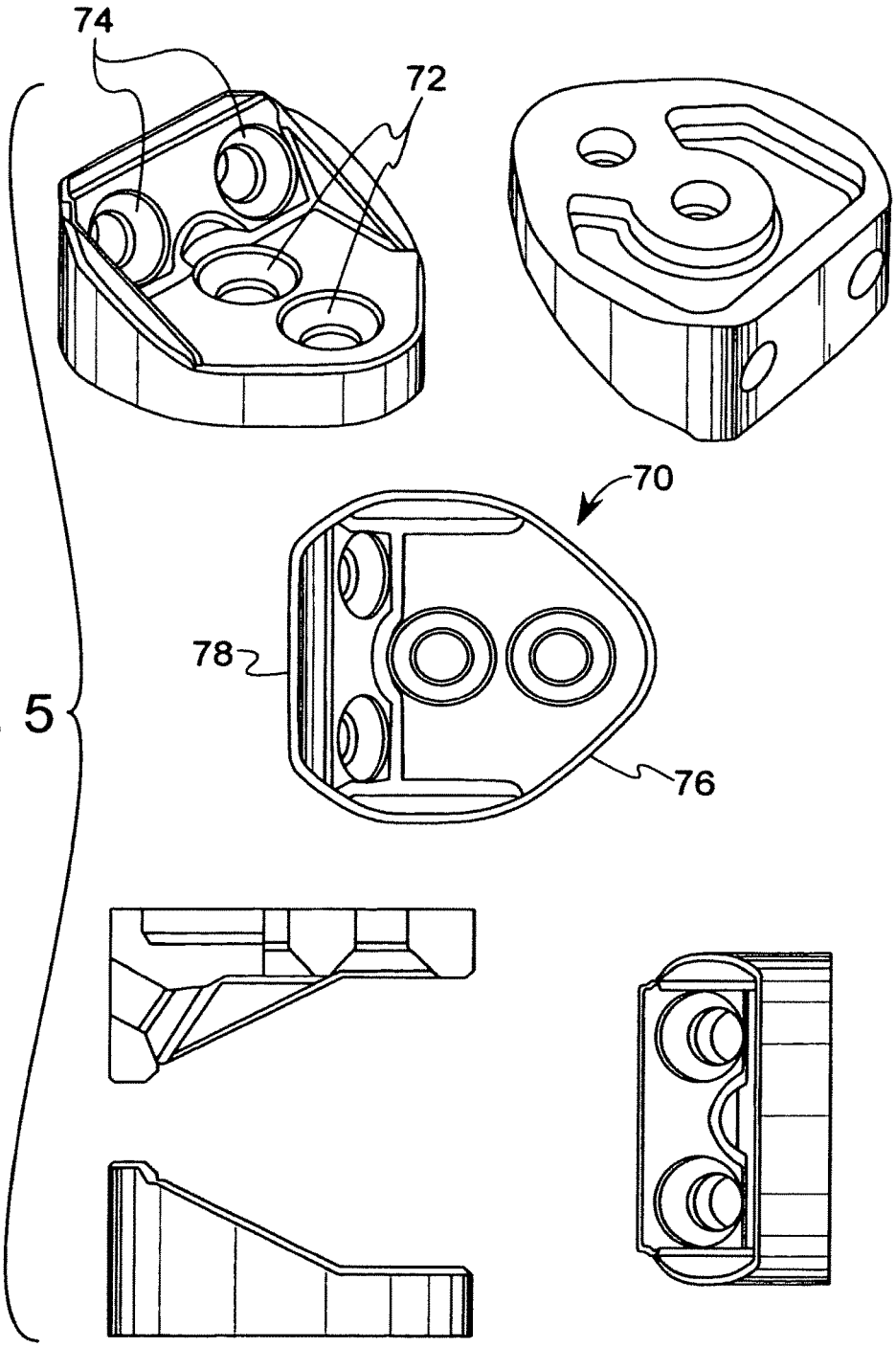
FIG. 5 illustrates various views of the exemplary embodiment of the bracket of FIG. 3I.
Figure 6:
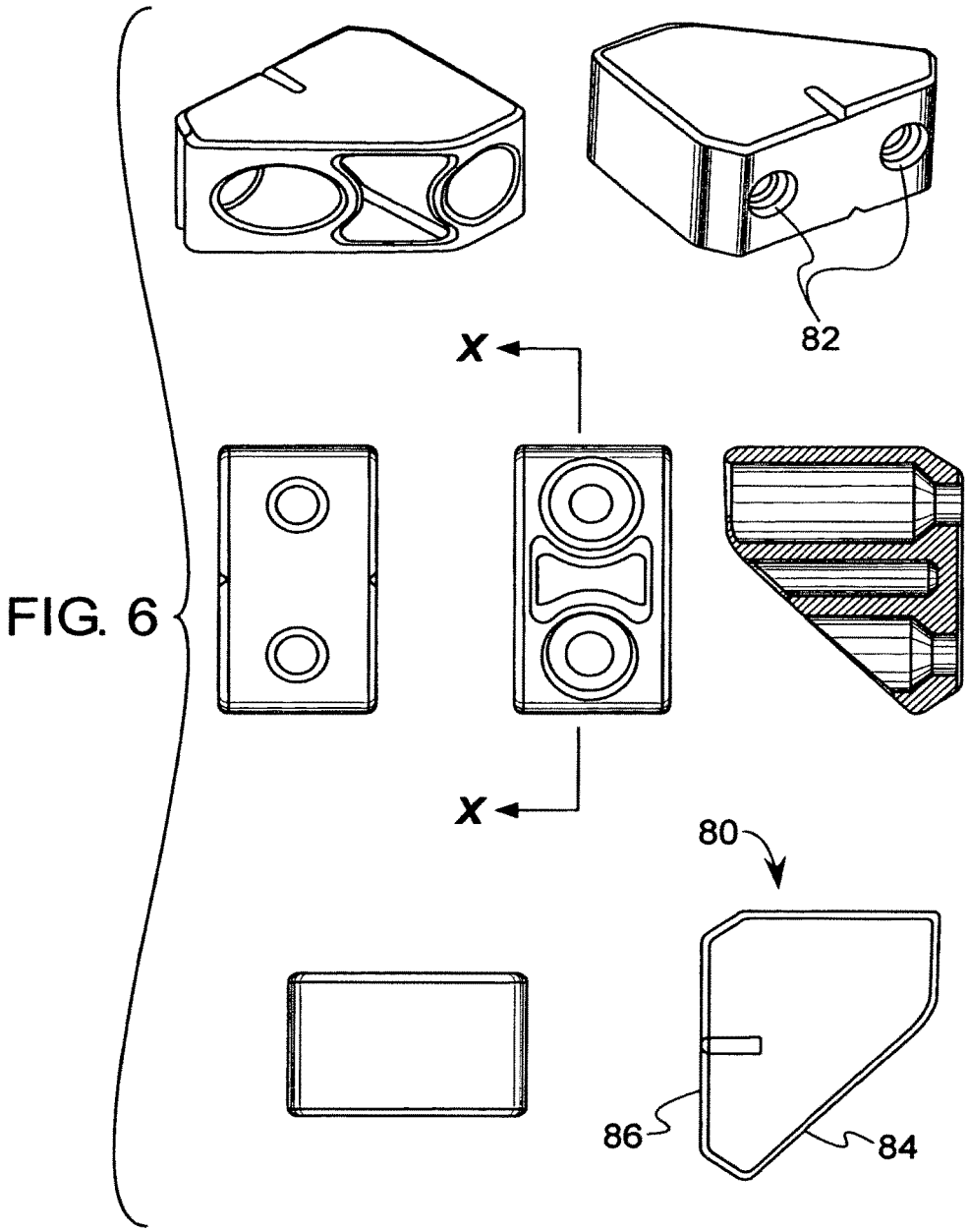
FIG. 6 illustrates various views of the exemplary embodiment of the support block of FIG. 3J.

FIGS. 5 and 6 illustrate a bracket 70 and support block 80, respectively, that may be used to connect the principal components of a handrail system together. Holes 72, 74, and 82 are adapted to accept fasteners 90 to facilitate the assembly of the rail system. Angled surface portions 76 and 84 on bracket 70 and support block 80, respectively, allow component connections over a range of angles to accommodate different installation configurations, such as angled walkways, decks, or stairways. As a result, in an exemplary embodiment of the present invention, bracket 70 and support block 80 may be used for perpendicular as well as angled connections of a rail to a post or post cover 20. Thus, the versatility of bracket 70 and support block 80 eliminates the need for different components for perpendicular and angled connections, which may lead to additional benefits including, but not limited to, reduced manufacturing cost and installation time.

In the example of FIG. 5, angled surface portion 76 is at about a 45-degree angle relative to surface portion 78, through which holes 74 extend. Similarly, in the example of FIG. 6, angled surface portion 84 is at about a 45-degree angle relative to surface portion 86, through which holes 82 extend. Such as in this example, at least one hole 82 may extend through surface portion 84 to surface portion 86. As will be shown in subsequent figures, the angled configurations of the bracket 70 and support block 80 may facilitate connections of a rail to a post or post cover 20 over a range of angles. Although these exemplary embodiments of bracket 70 and support block 80 may be used for a 45-degree connection of a rail to a post or post cover 20, it should also be recognized that these exemplary components may be used to for other angled connections (e.g., less than or greater than 45 degrees) of a rail to a post or post cover 20. In addition, it should be recognized that other exemplary embodiments of the bracket and support block may have angled configurations that are less than or greater than 45 degrees and may also allow connections over a range of angles. In fact, in some exemplary embodiments of the present invention, the bracket and support block may not have angled configurations and may still allow for connections over a range of angles.

Figure 7:
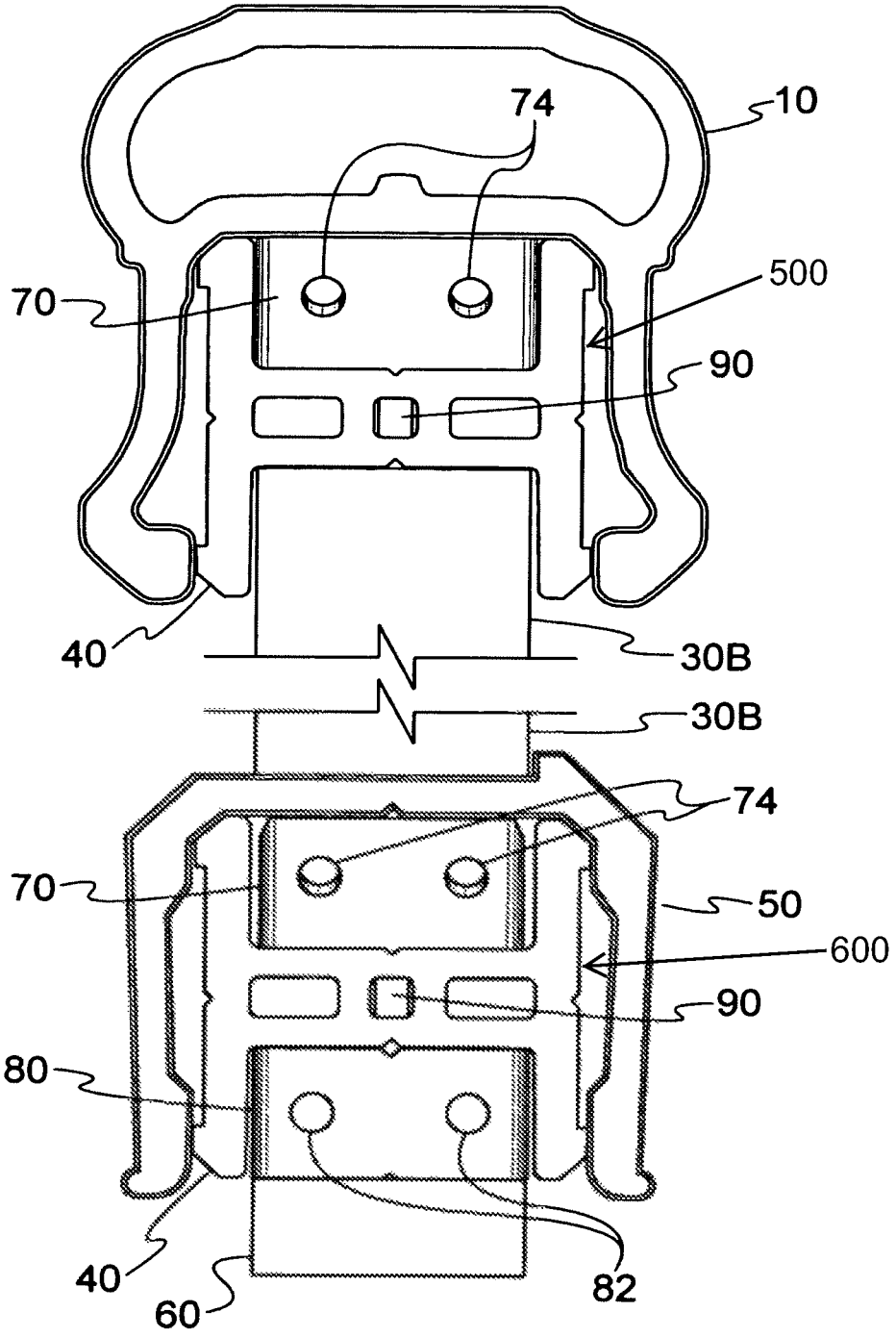
FIG. 7 is a partial, cross-sectional view of an exemplary installation of a rail system using at least some of the components of FIGS. 3A through 3K.

FIG. 7 illustrates one exemplary embodiment of component assembly for perpendicular or angled connections of rails to a post or post cover. In this example, support block 80 is used to support lower support rail 40. Holes 82 are provided so that the support block 80 may be secured to a post, a post cover, or any other desired support structure by fasteners. Optionally, a support block may also include other holes for receiving fasteners to secure the support block to a support rail. Brackets 70 may be similarly used to secure support rails 40 to a post, post cover, or any other desired support structure. In particular, fasteners may be inserted through holes 74 to secure brackets 70 to a support structure. In addition, although not visible in this view, fasteners may also be inserted through holes 72 to secure each bracket 70 to a support rail 40.

Support rails 40 provide a structural foundation upon which to attach top rail 10 and bottom rail 50. Each rail has a cavity that is adapted to receive a support rail 40. For example, such as shown in FIG. 7, each rail may have a cavity that is adapted to mate with a support rail 40. Upper rail 10 and lower rail 50 may simply be placed over respective support rails 40, which promotes a relatively easy installation. Fasteners 90 may be used to secure top rail 10 and bottom rail 50 to the respective support rails 40. As can be seen in FIG. 7, this configuration enables support rails 40, brackets 70, support block 80, and fasteners 90 to be substantially or totally obscured from view during normal use of the railing assembly. Moreover, in addition to the pleasing aesthetic appearance of the resulting railing assembly, this exemplary embodiment of the present invention provides a weather-resistant covering for the support components.

In the example of FIG. 7, each support rail 40 is oriented such that it has a generally H-shaped configuration. This orientation enables the brackets 70 and support block 80 to provide both perpendicular and angled connections of a rail over a range of angles, wherein the rail may be generally horizontal, if desired. As mentioned above, fasteners 90 may be used to secure top rail 10 and bottom rail 50 to respective support rails 40. Fasteners 90 may also be used to connect balusters 30B and squash block 60 to respective support rails 40. Additionally, alignment grooves 42, as illustrated in FIG. 3B, may be provided on support rail 40 to provide an easy and quick method of locating fasteners 90 along the centerline, if desired, of the support rail 40. For the same reason, bottom rail 50 may optionally include an alignment groove 52. Similarly, top rail 10 may include an alignment groove, if desired. Optionally, holes may also be provided in predetermined locations (e.g., in the alignment grooves 42 and 52) for the reception of fasteners 90. Such fastener holes may be pre-drilled or otherwise pre-formed before assembly, or such fastener holes may be drilled or otherwise formed during assembly.

Figure 8A:
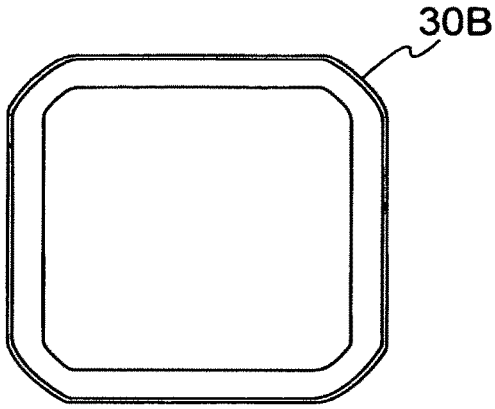
FIG. 8A is a cross-sectional view of an exemplary embodiment of a baluster of a rail system.
Figure 8B:
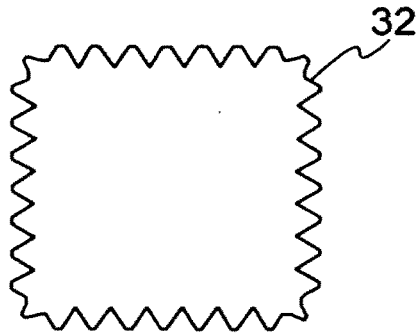
FIG. 8B is a cross-sectional view of an exemplary embodiment of a baluster plug.
Figure 8C:
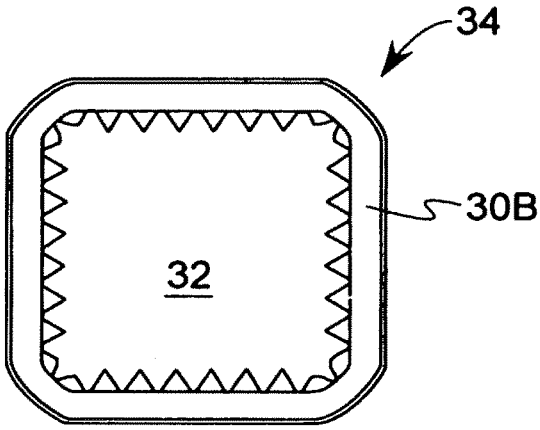
FIG. 8C is a cross-sectional view of the baluster of FIG. 8A with baluster plug of FIG. 8B installed.
Figure 8D:
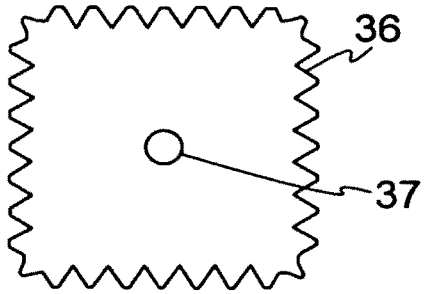
FIG. 8D is a cross-sectional view of an exemplary embodiment of a baluster plug with a hole.
Figure 8E:
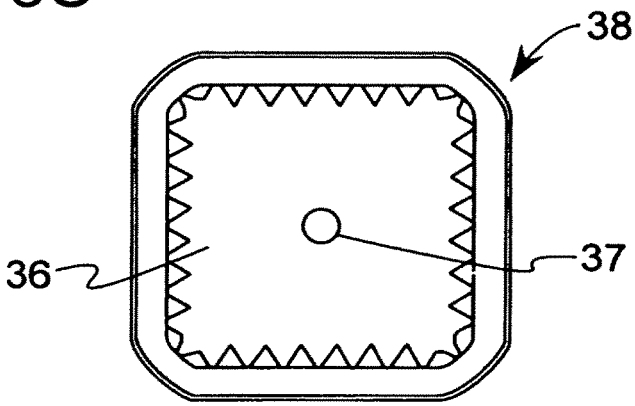
FIG. 8E is a cross-sectional view of an exemplary embodiment of a baluster with the baluster plug of FIG. 8D installed.

FIG. 8A illustrates a cross-sectional view of another exemplary embodiment of a baluster 30B, which may be a hollow tubular-like structure. FIG. 8B illustrates an example of an exemplary embodiment of a baluster plug 32, which optionally may comprise a grooved periphery to allow the application and retention of an adhesive or bonding agent. FIG. 8C illustrates a cross-sectional view of a baluster assembly 34 with may comprise a baluster 30B with a baluster plug 32 installed on at least one end portion of the baluster 30B. Alternatively, a single baluster plug 32 may extend the full length of the baluster 30B. In either case, the baluster plug or plugs 32 may be drilled before or after assembly within the baluster 30B to accommodate appropriate assembly fasteners 90. FIG. 8D depicts a baluster plug 36 comprising a pre-drilled or otherwise pre-formed fastener hole 37. For example, baluster plug 36 may be molded (e.g., extruded) such that it has fastener hole 37. FIG. 8E illustrates an example of a baluster assembly 38 that includes baluster plug(s) 36. It should be noted that the baluster 30B and baluster plugs 32 and 36 may be comprised of a plastic, plastic composite material, or any other similar or suitable material such as described herein and may be fabricated by molding, extrusion, or any other suitable process or method known to those skilled in the art. Furthermore, it should be recognized that exemplary embodiments of a squash block may also be comprised of components similar to the above-described baluster assemblies 34 and 38.

Figure 9:
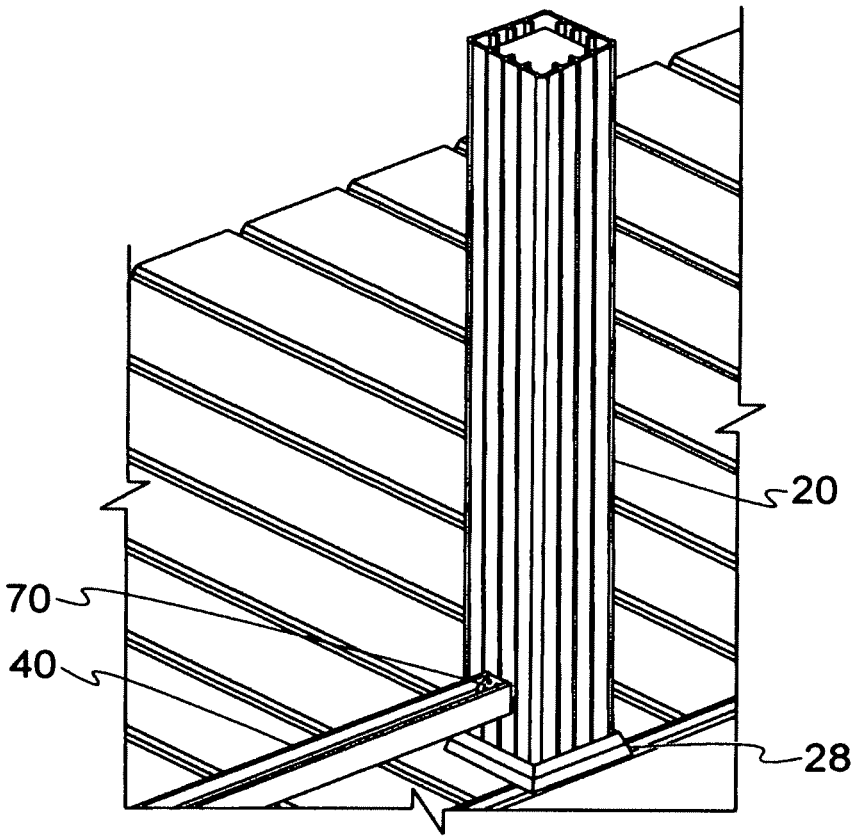
FIG. 9 is a partial perspective view of an exemplary embodiment of an installed lower support rail.
Figure 10:
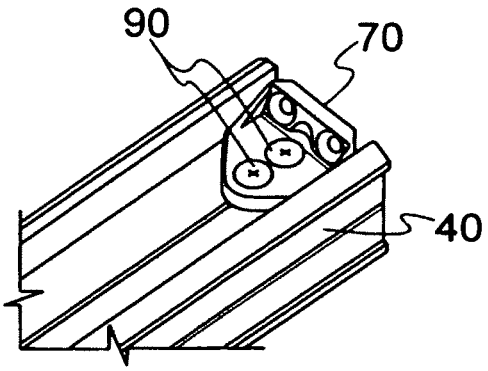
FIG. 10 is a partial perspective view illustrating an exemplary manner of attaching a bracket to a support rail.
Figure 11:
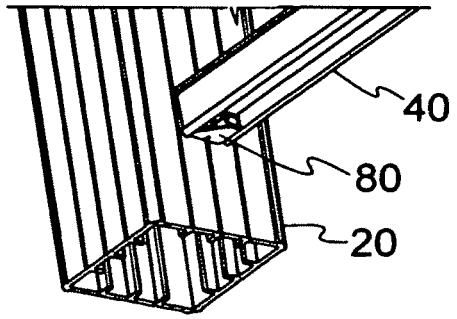
FIG. 11 is another partial perspective view of an exemplary embodiment of an installed lower support rail.

FIGS. 9 through 11 illustrate various views of an exemplary assembly configuration showing the installation of a lower support rail 40. In this example, support rail 40 is substantially perpendicular to post cover 20. As shown in the partial view of FIG. 11, support rail 40 rests on support block 80. Although FIG. 11 shows a straight rail configuration, it is evident that support block 80 would enable angled connections up to about 45 degrees in this example. In addition, as shown in FIGS. 9 and 10, a bracket 70 is used to secure support rail 40 to the post cover 20. In this exemplary configuration, fasteners 90 are aligned with the centerline of support rail 40.

Figure 12:
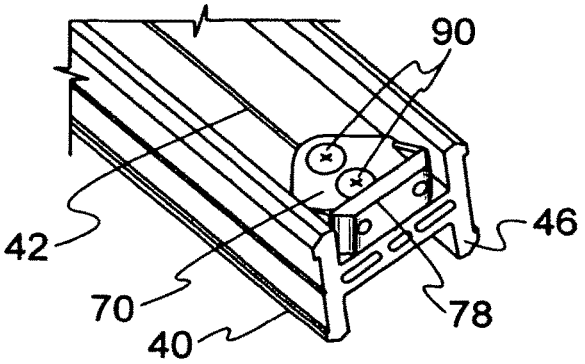
FIG. 12 is another partial perspective view illustrating an exemplary manner of attaching a bracket to a support rail.
Figure 13:
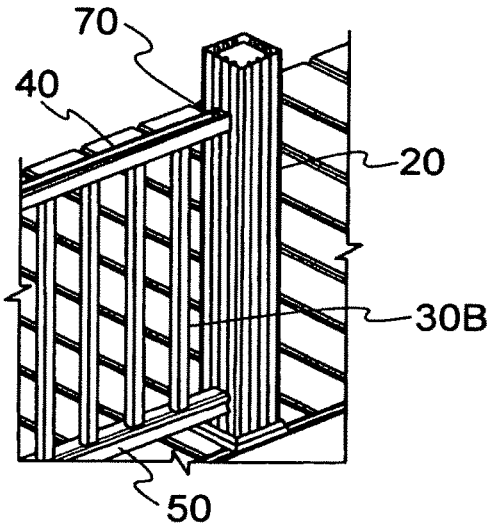
FIG. 13 is a partial perspective view of an exemplary manner of attaching a bottom rail and balusters to an upper support rail.

FIGS. 12 and 13 show in more detail the component relationship between a bracket and support rail in a straight rail configuration. As shown in FIG. 12, surface portion 78 of bracket 70 may be substantially aligned with edge 46 of support rail 40. Fasteners 90 may be inserted through holes 72 in bracket 70 to secure bracket 70 to support rail 40. Fasteners 90 may also be inserted through holes 74 in surface portion 78 in order to secure bracket 70 and support rail 40 to post cover 20. FIG. 13 shows lower rail 50 installed over lower support rail 40. FIG. 13 also shows the installation of balusters 30B and upper support rail 40. In an exemplary embodiment, balusters 30B may be pre-assembled between upper support rail 40 and lower rail 50 using fasteners 90 so that these components may be installed as a single unit to facilitate installation in the field. Prior to being fastened, balusters 30B may be spaced along the rail as desired.

In the example of FIG. 12, it should be note that the support rail 40 embodies an alignment groove 42, which provides a ready reference that may be used to easily locate fasteners 90 for securing bracket 70 to support rail 40. As previously noted, support rail 40 may be drilled or otherwise provided with holes to accommodate assembly fasteners 90. The alignment groove 42 may be embodied onto the surface of the support rail 40 by means of a groove during the manufacturing process, such as extrusion, or it may be subsequently applied by means of a marking method, such as through the use of marking inks, etching, or other methods known to those knowledgeable in the art.

Figure 14:
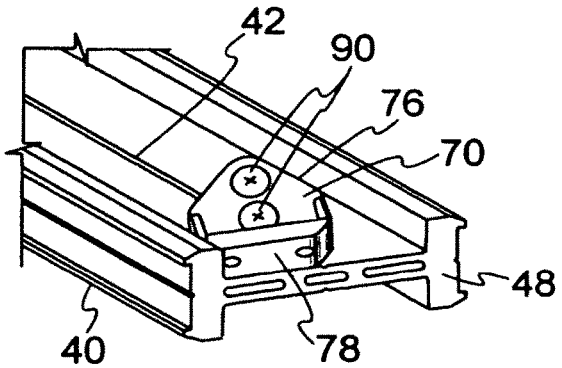
FIG. 14 is a partial perspective view of an exemplary manner of attaching a bracket to a support rail for an angled installation of a rail.
Figure 15:
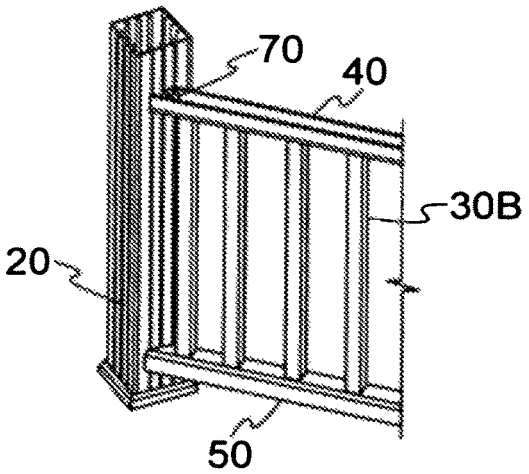
FIG. 15 is a partial perspective view of an exemplary manner of attaching a bottom rail and balusters to an upper support rail for an angled installation of a rail.

FIGS. 14 and 15 illustrate an example of how bracket 70 may be attached to support rail 40 for an angled rail installation. In this example, support rail 40 may be cut or formed in any other suitable manner such that it has an angled edge 48. The angle of edge 48 may be selected to provide the desired angular connection between the rail and post cover 20. Surface or face portion 78 of bracket 70 may be substantially aligned with angled edge 48 of support rail 40. Fasteners 90 may be inserted through holes 72 in bracket 70 in order to secure bracket 70 to support rail 40. As shown in this example, at least one of the holes 72 may aligned with optional alignment groove 42 in order to properly position bracket 70 on support rail 40. In other words, the center fastener is aligned with the alignment groove 42 in this example. As depicted in FIG. 15, angled edge 48 may be situated against post cover 20. Fasteners 90 may be inserted through holes 74 in surface portion 78 in order to secure bracket 70 and support rail 40 to post cover 20, thereby providing the desired angular connection. Lower rail 50 may have an edge that has an angle similar to that of edge 48, and it may be situated over lower support rail 40 as shown in FIG. 15. FIG. 15 also shows balusters 30B and upper support rail 40.

Figure 16:
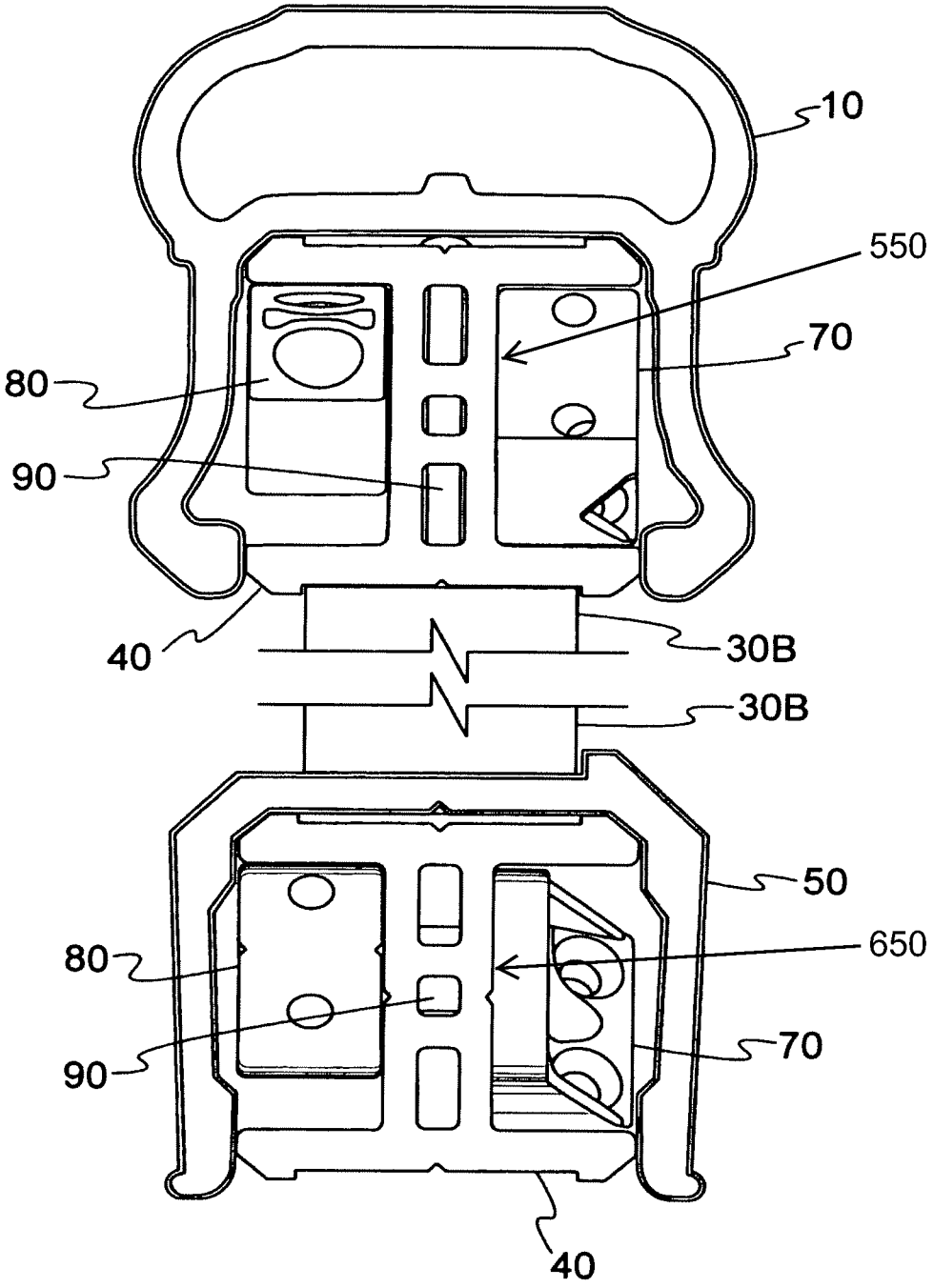
FIG. 16 is a partial, cross-sectional view of an exemplary installation of a rail system in a stair rail application.

FIG. 16 shows a different arrangement of the above-described components for applications requiring rails on changing elevations, for example, as in a stair rail. This configuration allows a rail to be connected to a support structure over a range of angles. As a result, this configuration may be used when a rail is supported at different levels, such as in a stair system or in any other system in which a rail is not level. Relative to the example shown in FIG. 7, support rails 40, brackets 70, and support blocks 80 are rotated about 90 degrees as shown in the example of FIG. 16. As a result, in this configuration, each support rail 40 is positioned such that it is substantially I-shaped. At least one of the support rails 40 is supported by a support block 80. Brackets 70 may be used in conjunction with fasteners 90 to effectively secure respective support rails 40 to a support structure, such as a post cover 20 or any other available support surface (e.g., a building wall). Fasteners 90 may also be used to secure support rail 40 to baluster 30B. Optionally, each support rail may have at least one alignment groove 44 to assist in aligning the support rail with baluster 30B. If desired, holes may also be provided in predetermined locations (e.g., in the alignment grooves 44 and 52) for the reception of fasteners 90. Such fastener holes may be pre-drilled or otherwise pre-formed before assembly, or such fastener holes may be drilled or otherwise formed during assembly.

Figure 17:
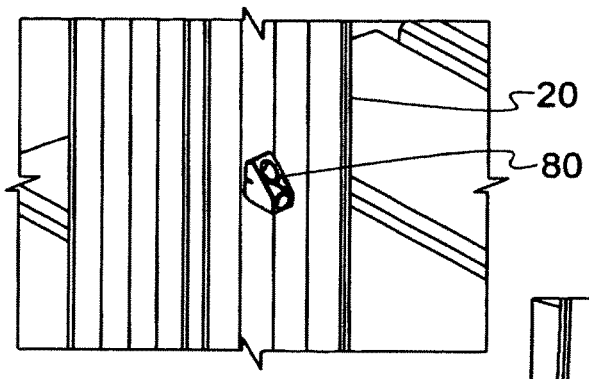
FIG. 17 is a partial perspective view illustrating an exemplary manner of attaching a support block to a post cover in a stair rail installation.
Figure 18:
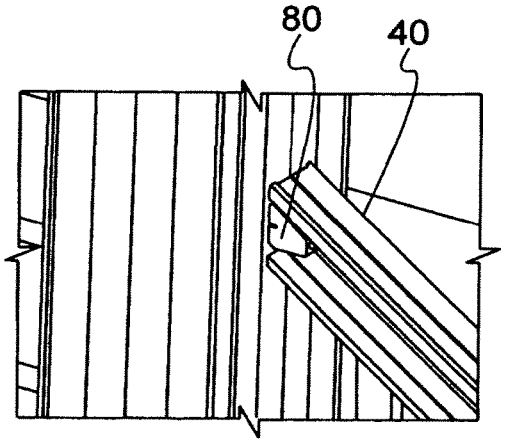
FIG. 18 is a partial perspective view illustrating an exemplary manner of attaching a support rail and support block to a post in a stair rail installation.
Figure 19:
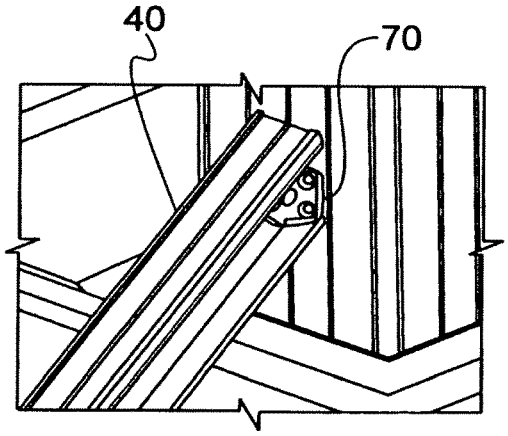
FIG. 19 is a partial perspective view illustrating an exemplary manner of attaching a support rail and bracket to a post in a stair rail installation.
Figure 20:
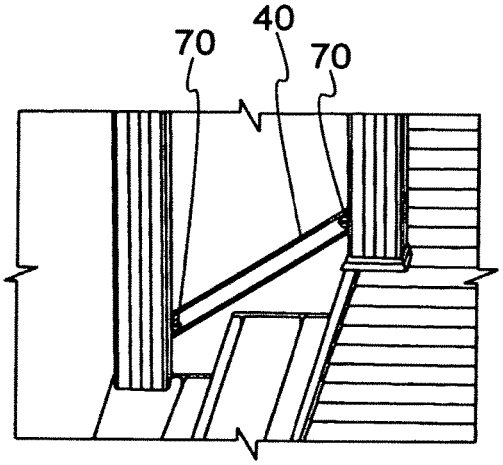
FIG. 20 is a partial perspective view illustrating an exemplary installation of a support rail between two posts in a stair rail application.

FIGS. 17 through 20 illustrate the component assembly relationships in an exemplary stair rail application requiring changes in rail elevation. As shown in FIG. 17, fasteners 90 may be inserted through holes 82 to secure support block 80 to post cover 20. FIG. 18 shows the subsequent positioning of a support rail 40 relative to support block 80. FIG. 19 depicts an exemplary attachment of a bracket 70 to a support rail 40. In an exemplary embodiment, bracket 70 may be pre-mounted to support rail 40 using fasteners 90. Fasteners 90 may also be inserted through holes 74 of bracket 70 to secure support rail 40 and bracket 70 to post cover 20. FIG. 20 illustrates an exemplary installation of a lower support rail 40 in a stair rail application.

Figure 21A:
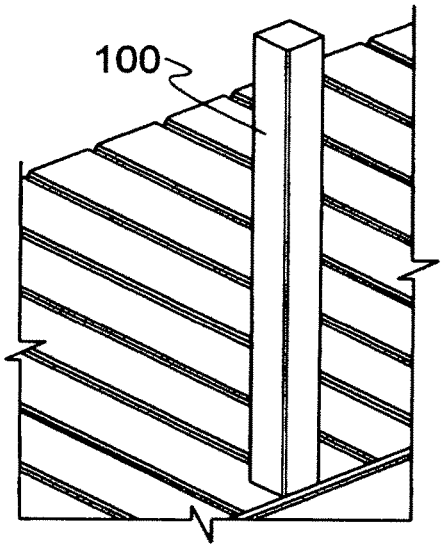
FIGS. 21A through 21H are partial perspective views illustrating a sequential step-by-step installation of an exemplary embodiment of a handrail system.
Figure 21B:
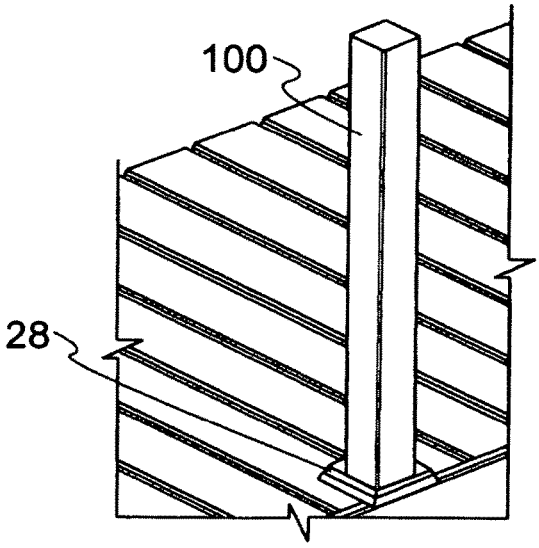
Figure 21C:
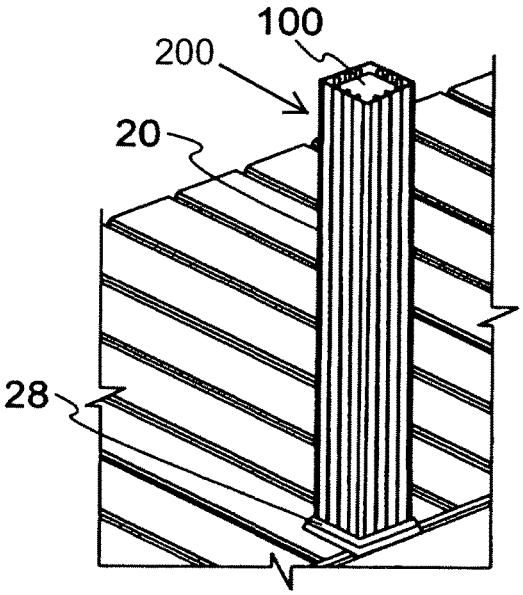
Figure 21D:
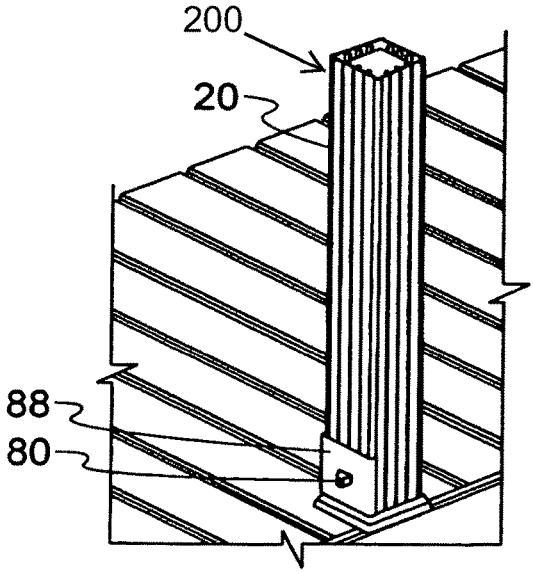
Figure 21E:
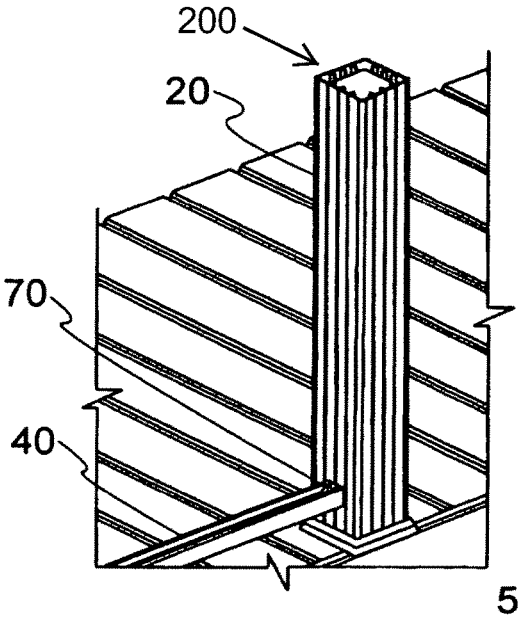
Figure 21F:
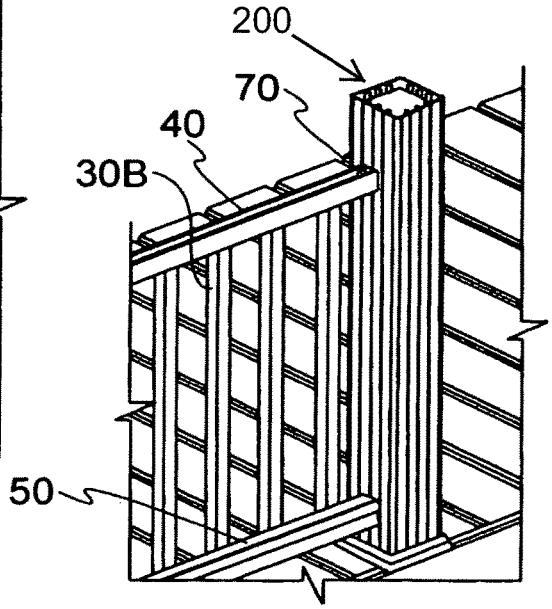
Figure 21G:
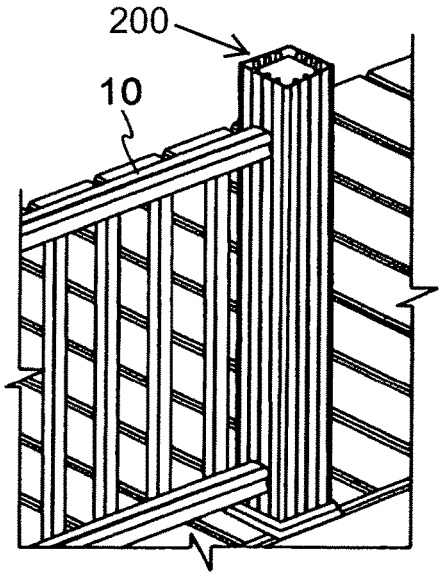
Figure 21H:
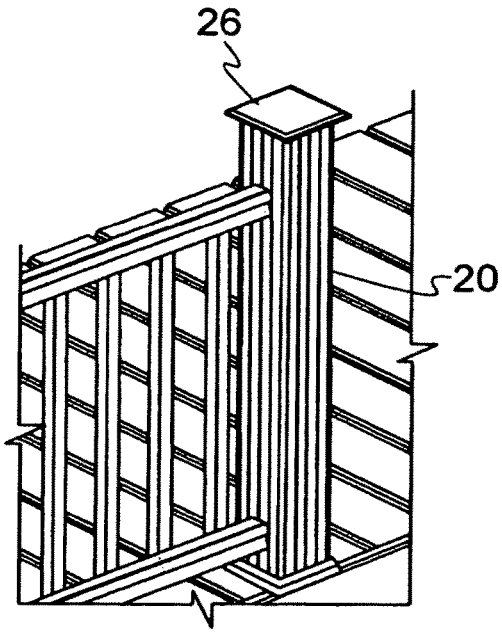

FIGS. 21A through 21H illustrate an exemplary set of sequential steps for an exemplary installation of this invention as a handrail guard. FIG. 21A depicts an installed post 100, which may be built, for example, on the perimeter of a residential deck. FIG. 21B illustrates the installation of a post skirt 28 around post 100. Post cover 20 is next installed over post 100, forming a rail post 200 and inserted into the post skirt 28 as shown in FIG. 21C. Support block 80 may be installed on the post cover 20 using an optional template 88 to assist with positioning, as shown in FIG. 21D. This optional template 88 may be placed on post skirt 28 to consistently position the support block 80 during installation and may be made of plastic, cardboard, metal, or any other suitable material. For convenience, it may be included as a "punch out" feature in the packaging for the railing components, or it may be supplied separately. If integrated into the packaging, it may be punched or cut out prior to or after the railing components have been removed from the packaging. In order to assist with positioning support block 80, an opening may be punched or cut out of template 88 for receiving support block 80, and the sides of template 88 may be folded such that template 88 wraps around opposing sides of post cover 20. In this exemplary embodiment, support block 80 is aligned with the centerline of post cover 20 for both angled and straight sections. Furthermore, support block 80 is oriented such that the angled edge is in the desired direction. FIG. 21E shows the placement of lower support rail 40 on support block 80 (not shown). Optionally, lower support rail 40 may be pre-assembled with at least one squash block 60, which may be secured with fasteners 90. In addition, bracket 70 may be secured to lower support rail 40 prior to placing lower support rail 40 on support block 80. After placing lower support rail 40 on support block 80, fasteners 90 may be used to secure bracket 70 and lower support rail 40 to post cover 20. Alternatively, lower support rail 40 may first be placed on support block 80, and then bracket 70 may be secured to lower support rail 40 and post cover 20 with fasteners 90. FIG. 21F next illustrates the installation of a lower rail 50, balusters 30B, and upper support rail 40. In an exemplary method, balusters 30B may first be secured between upper support rail 40 and lower rail 50 to form a sub-assembly. As can be seen in FIG. 3C, lower rail 50 may optionally include a protruding edge 54, which may provide a convenient alignment surface against which to mount balusters 30B. The sub-assembly may then be installed such that the lower rail 50 is positioned over lower support rail 40. In other exemplary installation methods, balusters 30B, upper support rail 40, and lower rail 50 may be installed individually or in various sub-combinations. It should be noted that a bracket 70 is installed on the upper support rail 40 and is subsequently connected to the post cover 20 to secure the rail assembly into position. FIG. 21G illustrates the installation of the upper rail 10, which may simply be placed over upper support rail 40. Fasteners 90 may subsequently be used to secure upper rail 10 to upper supper rail 40. Lastly, FIG. 21H shows the installation of a finishing post cover cap 26 onto the post cover 20 to provide a weather-resistant barrier to the elements and provide a pleasing finished look to the rail system. For example, fasteners 90 may be inserted (e.g., screwed) upward through upper support rail 40 in order to engage and secure upper rail 10.

Figure 22A:
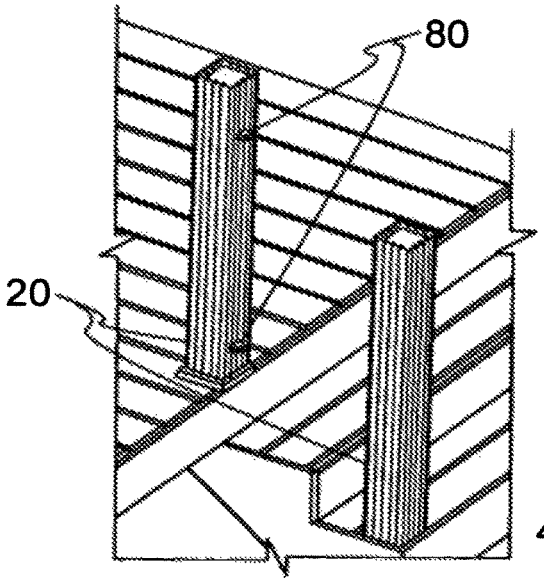
FIGS. 22A through 22D are partial perspective views illustrating a sequential step-by-step installation of an exemplary embodiment of a stair rail system.
Figure 22B:
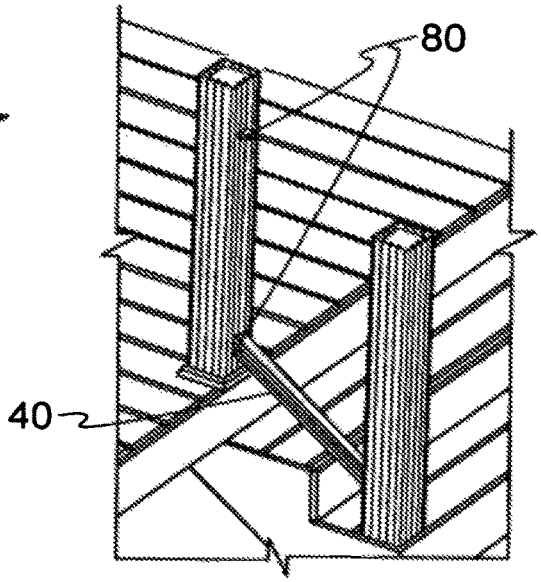
Figure 22C:
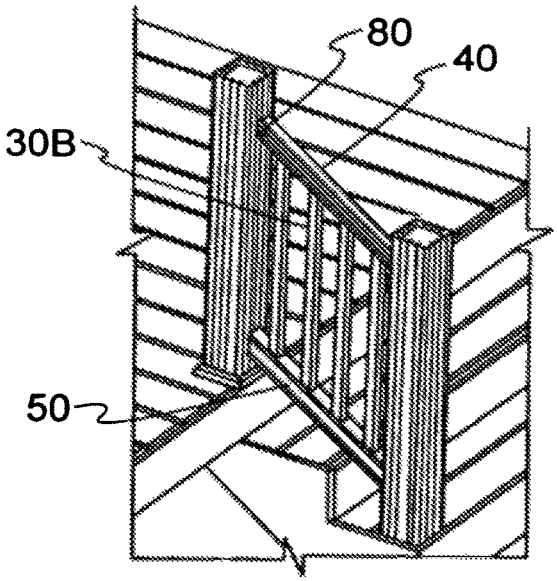
Figure 22D:
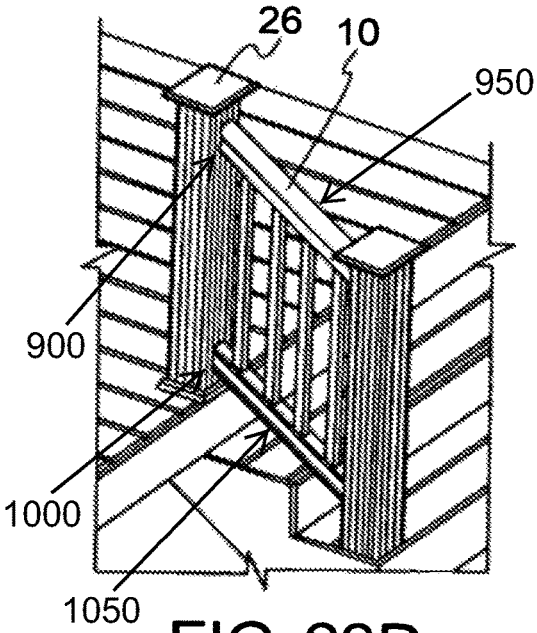

FIGS. 22A through 22D illustrate an exemplary set of sequential steps of an exemplary installation of this invention as a stair rail guard. FIG. 22A shows an installation of two post covers 20 and support blocks 80. As described above with regard to the handrail application, support blocks 80 may be positioned using an optional template or templates. FIG. 22B next shows an installation of a lower support rail 40, which is supported by a support block 80 on each post cover 20. Such as shown in FIG. 16 or FIG. 19, brackets 70 may be used to secure lower support rail 40 to each post cover 20. In an exemplary method, brackets 70 may be secured to lower support rail 40 prior to or during installation. FIG. 22C next shows the installation of balusters 30B, lower rail 50, and upper support rail 40. Balusters 30B may be cut, mitered, or otherwise formed to have angled edges suitable for this type of application. Similar to the above-described installation of a handrail, balusters 30B may first be secured between upper support rail 40 and lower rail 50 to form a sub-assembly. The sub-assembly may then be installed such that the lower rail 50 is positioned over lower support rail 40. In other exemplary installation methods, balusters 30B, upper support rail 40, and lower rail 50 may be installed individually or in various sub-combinations. Again, it should be noted that a bracket 70 is installed on the upper support rail 40 and is subsequently connected to the post cover 20 to secure the rail assembly into position. Finally, FIG. 22D shows the installation of the upper rail 10 and post cover caps 26 to complete an exemplary stair rail assembly.

The foregoing examples demonstrate how various angled connections may be formed. FIG. 7 shows a top support rail received by a top rail in a first position 500 as well as a bottom support rail received by a bottom rail in a first position 600. Conversely, FIG. 16 shows a top support rail received by a top rail in a second position 550 as well as a bottom support rail received by a bottom rail in a second position 650. FIG. 4 shows an example of an angled connection 700 between a top support rail and a support structure in a first plane 750. FIG. 4 also shows an example an angled connection 800 between a bottom support rail and a support structure in a first plane 850. FIGS. 9-15 and 21E-21H show further examples of how to make angled connections in a first plane (e.g., a horizontal plane in these examples as well as FIG. 4 for a deck rail). In particular, FIG. 15 shows a different example of an angled connection in a horizontal plane. On the other hand, FIG. 22D shows an example of an angled connection 900 between a top support rail and a support structure in a second plane 950. FIG. 22D also shows an example an angled connection 1000 between a bottom support rail and a support structure in a second plane 1050. FIGS. 19, 20, and 22B-22C show examples of how to make angled connections in a second plane (e.g., a vertical plane in these examples as well as FIG. 22D for a stair rail).

Unless expressly claimed otherwise, a component of the present invention may be made from any suitable material. Although many materials may be used to fabricate the components disclosed in this invention, one exemplary embodiment may employ composite material that may be resistant to weathering and easily integrated into structures, such as railing. In one exemplary embodiment, a capstock layer (e.g., a PVC capstock layer) may be placed over a composite substrate to form an upper rail 10, support rail 60, bottom rail 50, squash blocks 60, balusters 30A, post covers 20, and ancillary components, such as post skirts 28 and caps 26, thereby providing a system of components that may be easily assembled into a rail. The capstock layer may be comprised of PVC, which may be placed over the composite substrate by any suitable fabrication method, such as co-extrusion, compression molding, injection molding, or other similar or suitable methods. The capstock layer and base material combination may allow lower cost, less attractive, and structurally rigid materials to be used as a base framework upon which an attractive and protective PVC capstock layer may be applied. Nevertheless, it should be recognized that other suitable materials may be used such as, but not limited to, wood, metal, composites, plastics, and other similar or suitable materials.

In one exemplary embodiment of the present invention, a substrate may be comprised of a composite that has a high cellulosic content. In particular, the composite may be comprised of cellulosic material in the amount of at least about 50% by weight and a plastic material in an amount of up to about 50% by weight. For instance, in one exemplary embodiment, the composite may be comprised of cellulosic material in the amount of about 55% by weight and a plastic material in an amount of about 45% by weight. In yet another exemplary embodiment, the composite may be comprised of cellulosic material in the amount of about 60% by weight and a plastic material in an amount of about 40% by weight.

The high cellulosic content enables the cost-effective production of a substrate that has desirable structural characteristics. For example, the high cellulosic content promotes the desired durability, rigidity, flexibility, and other structural characteristics for a variety of types of components. For instance, the high cellulosic content may enable the cost-effective production of railing components that exceed load testing requirements.

The cellulosic material may be virgin or recycled. Examples of cellulosic material include sawdust, newspapers, alfalfa, wheat pulp, wood chips, wood fibers, wood particles, ground wood, wood flour, flax, wood flakes, wood veneers, wood laminates, paper, cardboard, straw, cotton, rice hulls, coconut shells, peanut shells, bagasse, plant fibers, bamboo fiber, palm fiber, kenaf, and other similar, suitable, or conventional materials. Any of the wood examples may be hard or soft wood or variations thereof. Furthermore, any desired mesh size of the cellulosic material can be used. With regard to wood flour, an exemplary range of mesh size is about 10 to about 100 mesh, more preferably about 20 mesh to about 80 mesh depending on the desired characteristics of the composite.

The cellulosic material may be dried to a desired moisture content prior to or during the formation of the base layer. For example, the cellulosic filler(s) may be dried to about 0.5% to about 3% moisture content by weight, more preferably to about 1% to about 2% moisture content by weight. However, it should be recognized that the cellulosic material may have a moisture content less than about 0.5% by weight or greater than about 3% by weight and still be within the scope of the present invention.

The plastic material may be comprised of virgin or recycled materials that may improve the characteristics of the reinforced composite and/or enhance the manufacture or moldability thereof. In an exemplary embodiment of the present invention, the plastic material is a PVC material, which enables the production of a component having structural characteristics suitable for railing or other structurally demanding applications. The PVC material may, for example, be made by mixing PVC resin with, optionally, at least one stabilizer, at least one lubricant, at least one process aid, and other optional ingredients (e.g., acrylic modifier, inorganic filler, and other suitable additives). Optionally, another plastic resin may also be included in the composite such as, but not limited to, acrylonitrile butadiene styrene (i.e., ABS) resin. An example of a mixer is a high intensity mixer such as those made by Littleford Day Inc. or Henschel Mixers America Inc. As an example, the mechanically induced friction may heat the ingredients to a temperature between about 200° F. and about 230° F. After mixing, the ingredients may be cooled to ambient temperature. Alternatively, the ingredients of the PVC material may be mixed together during the formation of the base layer.

With reference to a plastic material that comprises PVC resin, the plastic material may include stabilizer(s) in an amount of about 1 to about 10 parts, more preferably about 2 to about 4 parts, per 100 parts of the PVC resin. The lubricant(s) may be present in an amount of about 2 to about 12 parts, more preferably about 4 to about 11 parts, per 100 parts of the PVC resin. Also, process aid(s) may be included in an amount of about 0.5 to about 8 parts, more preferably about 0.7 to about 3 parts, per 100 parts of the PVC resin. Optionally, acrylic modifier(s) (e.g., impact modifiers) may be present in an amount of about 1 to about 10 parts, more preferably about 4 to about 8 parts, per 100 parts of the PVC resin. As a further option, inorganic filler(s) may be added in an amount of up to about 10 parts, more preferably about 3 to about 9 parts, per 100 parts of the PVC resin. In addition, another plastic resin (e.g., ABS resin or any other similar or suitable resin) may be included in an amount up to about 50% by weight of the composite, more preferably about 5-10% by weight of the composite.

Stabilizer(s) may be employed to limit or prevent the breakdown of the plastic material during molding. Examples of stabilizers include tin stabilizers, lead and metal soaps such as barium, cadmium, and zinc, and other similar or suitable materials.

Internal or external lubricant(s) may aid in the molding process. Lubricants may be added to the plastic material to assist the reinforced composite through an extruder, compounder, or other molding machine, and to help facilitate mold release. Examples of lubricants include zinc stearate, calcium stearate, esters, amide wax, paraffin wax, ethylene bis-stearamide, and other similar or suitable materials.

Process aid(s) may aid in the fusion of the compound. Examples of process aids include acrylic process aids and other similar or suitable materials for improving the fusion of the compound. R&H K-120N and R&H K-175 are examples of acrylic process aids that are available from Rohm & Haas.

Acrylic modifier(s) may improve the physical characteristics of the compound. One example of an impact modifier is Arkema P530. Another example of an acrylic modifier is R&H K-400, which is available from Rohm & Haas. Although R&H K-400 is a high molecular weight acrylic modifier that is specifically designed for PVC foam applications, the inventors have discovered that it may also improve the physical characteristics of the base layer of the present invention, which has a high cellulosic content and may not include any foaming or blowing agents.

Inorganic filler(s) may be used to increase the bulk density of the reinforced composite. The use of inorganic filler may also improve the ability to process the reinforced composite, thereby allowing for higher rates of manufacture (e.g., extrusion). Inorganic filler may also allow the reinforced composite to be molded into articles having reduced moisture sensitivity and reduced flame and smoke spread. Examples of inorganic fillers include talc, calcium carbonate, kaolin clay, magnesium oxide, titanium dioxide, silica, mica, barium sulfate, wollastanite, acrylics, and other similar or suitable materials.

Other optional ingredients that may be included in the PVC material include, but are not limited to, polymers, plastics, thermoplastics, rubber, cross-linking agents, accelerators, inhibitors, enhancers, blowing agents/foaming agents, compatibilizers, thermosetting materials, pigments, weathering additives, and other similar or suitable materials.

Blowing agent(s) may be used to reduce the cost (e.g., by reducing the amount of polymer used in the composite) and weight of the composite material. A blowing agent may be an endothermic or exothermic blowing agent. An example of a chemical endothermic blowing agent is Hydrocerol BIH (i.e., sodium bicarbonate/citric acid), which is available from Clariant Corp., whereas an example of a chemical exothermic foaming agent is azodicarbonamide, which is available from Uniroyal Chemical Co.

The use of thermosetting materials may, for example, reduce moisture absorption and increase the strength of products manufactured from the reinforced composite material. Examples of thermosetting materials include polyurethanes (e.g., isocyanates), phenolic resins, unsaturated polyesters, epoxy resins, and other similar or suitable materials. Combinations of the aforementioned materials are also examples of thermosetting materials.

Pigments may be used to give the composite a desired color (e.g., white, cedar, gray, and redwood). Examples of pigments include titanium dioxide, iron oxide, and other similar or suitable colorant additives.

Titanium dioxide is also an example of a weathering additive. Other similar or suitable weathering additives include, but are not limited to, other ultraviolet absorbers. Examples of other ultraviolet absorbers include organic chemical agents such as benzophenone and benzotriazole types.

Due to the high cellulosic content of some exemplary embodiments, a base layer may not provide the desired aesthetic characteristics. As a result, the present invention may provide a capstock layer on the base layer. The capstock layer is preferably comprised of PVC. The use of a capstock layer may enable lower cost, less attractive, yet structurally desirable materials that have a high cellulosic content to be used as the base framework. For instance, the capstock layer may be applied on the base layer to provide an attractive and protective finish for the component. For example, the capstock layer may be provided in any desired color (e.g., to match the appearance of a deck or building exterior), and it may have a smooth outer surface or a pattern or texture formed on its outer surface.

FIGS. 1 and 2 show examples in which a capstock layer covers the entire exterior surface of the profile. If desired, a capstock layer may also be applied on the interior surface of the profile. It should also be recognized that a capstock layer may only cover a limited portion of the interior or exterior surface of the base layer in certain embodiments of the present invention.

A component of the present invention may be manufactured using any suitable manufacturing techniques. For example, a base layer and a capstock layer may be co-extruded. Alternatively, the capstock layer may be applied on the base layer (or vice versa) in a sequential extrusion process. Other molding techniques including, but not limited to, injection molding and compression molding may be used to manufacture a component of the present invention. In addition, it should be recognized that the optional layers of a component may be formed separately and then joined then in a subsequent process, such as with the use of adhesives or other suitable bonding materials.

EXAMPLES

One example of a composite that may be used to make a component comprises ingredients in the following amounts:

| INGREDIENT | PARTS PER 100 PARTS OF RESIN | WEIGHT PERCENT |
|---|---|---|
| wood flour | 150 | 55.1 |
| PVC resin | 100 | 36.8 |
| lubricant | 7.5 | 2.8 |
| acrylic modifier | 6 | 2.2 |
| calcium carbonate | 5 | 1.8 |
| tin stabilizer | 2.5 | 0.9 |
| process aid | 1 | 0.4 |

Another example of a composite that may be used to make a component comprises ingredients in the following amounts:

| INGREDIENT | PARTS PER 100 PARTS OF RESIN | WEIGHT PERCENT |
|---|---|---|
| wood flour | 183 | 60 |
| PVC resin | 100 | 32.8 |
| lubricant | 7.5 | 2.5 |
| acrylic modifier | 6 | 2 |
| calcium carbonate | 5 | 1.6 |
| tin stabilizer | 2.5 | 0.8 |
| process aid | 1 | 0.3 |

A third example of a composite that may be used to make a component comprises ingredients in the following amounts:

| INGREDIENT | PARTS PER 100 PARTS OF RESIN | WEIGHT PERCENT |
|---|---|---|
| wood flour | 146.6 | 50.0 |
| PVC resin | 100 | 34.1 |
| ABS resin | 18.4 | 6.3 |
| thermal stabilizer | 3.75 | 1.3 |
| lubricant | 10 | 3.4 |
| impact modifier | 6.0 | 2.1 |
| process aid | 1 | 0.3 |
| calcium carbonate | 7.5 | 2.6 |

A fourth example of a composite that may be used to make a component comprises ingredients in the following amounts:

| INGREDIENT | PARTS PER 100 PARTS OF RESIN | WEIGHT PERCENT |
|---|---|---|
| wood flour | 179.3 | 55.0 |
| PVC resin | 100 | 30.7 |
| ABS resin | 18.4 | 5.7 |
| thermal stabilizer | 3.75 | 1.2 |
| lubricant | 10 | 3.1 |
| impact modifier | 6.0 | 1.8 |
| process aid | 1 | 0.3 |
| calcium carbonate | 7.5 | 2.3 |

A fifth example of a composite that may be used to make a component comprises ingredients in the following amounts:

| INGREDIENT | PARTS PER 100 PARTS OF RESIN | WEIGHT PERCENT |
|---|---|---|
| wood flour | 220 | 60.0 |
| PVC resin | 100 | 27.3 |
| ABS resin | 18.4 | 5.0 |
| thermal stabilizer | 3.75 | 1.0 |
| lubricant | 10 | 2.7 |
| impact modifier | 6.0 | 1.6 |
| process aid | 1 | 0.3 |
| calcium carbonate | 7.5 | 2.1 |

While specific examples of materials may be given for making the components of the present invention, it should again be recognized that the present invention is not limited to the use of any particular materials unless expressly claimed otherwise.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A rail system adapted to be connected to a support structure, said rail system comprising:

a support rail;

a rail adapted to extend over said support rail, said support rail adapted to be positioned relative to said rail in a first position in a first instance and a second position in a second instance, said first position facilitating angled connections between said support rail and said support structure in a first plane, and said second position facilitating angled connections between said support rail and said support structure in a second plane different from said first plane; and a support bracket adapted to be positioned between said support rail and said rail to secure said support rail to said support structure.

2. The rail system of claim 1 wherein:

said angled connections in said first plane are substantially horizontal to facilitate deck rail applications; and said angled connections in said second plane are substantially vertical to facilitate stair rail applications.

3. The rail system of claim 1 wherein said support rail and said rail are comprised of a composite material.

4. The rail system of claim 3 wherein said composite material includes cellulosic filler.

5. The rail system of claim 4 wherein said composite material is capped by a capstock layer.

6. The rail system of claim 1 wherein said support structure is a rail post.

7. The rail system of claim 6 wherein said rail post further comprises:

a post; and a post cover extending around said post.

8. The rail system of claim 1 further comprising:

a second support rail;

a second rail adapted to extend over said second support rail, said second support rail adapted to be positioned relative to said second rail in a first position in a first instance and a second position in a second instance, said first position facilitating angled connections between said second support rail and said support structure in said first plane, and said second position facilitating angled connections between said second support rail and said support structure in said second plane; and a second support bracket adapted to be positioned between said second support rail and said second rail to secure said second support rail to said support structure.

9. The rail system of claim 8 further comprising at least one baluster interposed between said second rail and said support rail.

10. The rail system of claim 9 wherein said at least one baluster is comprised of a body that holds a baluster plug that defines a fastener hole, wherein said baluster plug is adapted to accommodate a fastener.

11. The rail system of claim 9 wherein said second rail further comprises a protruding edge adapted to align said at least one baluster.

12. The rail system of claim 8 wherein said second support rail is adapted to receive a squash block.

13. The rail system of claim 8 wherein said support bracket and said second support bracket each has at least one angled surface portion adapted to allow said angled connections to said support structure.

14. The rail system of claim 8 wherein:

said support bracket is adapted to be substantially hidden from view between said support rail and said rail when installed during normal use of said rail system; and said second support bracket is adapted to be substantially hidden from view between said second support rail and said second rail when installed during normal use of said rail system.

15. The rail system of claim 8 said support rail and said second support rail each has an H-shaped cross section.

16. A rail system adapted to be connected to a support structure, said rail system comprising:

a support rail;

a rail adapted to extend over said support rail; and a support bracket adapted to be positioned between said support rail and said rail in a first position in a first instance and a second position in a second instance to secure said support rail to said support structure, said second position different from said first position, said first position facilitating a first angled connection between said support rail and said support structure, and said second position facilitating a second angled connection different from said first angled connection between said support rail and said support structure.

17. The rail system of claim 16 wherein said first angled connection and said second angled connection are both substantially horizontal to facilitate deck rail applications.

18. The rail system of claim 16 wherein said first angled connection and said second angled connection are substantially vertical to facilitate stair rail applications.

19. The rail system of claim 16 wherein said support rail is adapted to be positioned relative to said rail in a first position in a first instance and a second position in a second instance, said first position facilitating angled connections between said support rail and said support structure in a first plane, and said second position facilitating angled connections between said support rail and said support structure in a second plane different from said first plane.

20. The rail system of claim 19 wherein said support rail, said rail, and said support bracket facilitate both substantially horizontal angled connections to a support structure and substantially vertical angled connections to a support structure.

* * * * *